US006116537A

United States Patent [19]

Kempas

[11] Patent Number: 6,116,537

[45] Date of Patent: Sep. 12, 2000

[54] SEEKER HEAD FOR MISSILES

[75] Inventor: Hagen Kempas, Überlingen, Germany

[73] Assignee: Bodenseewerk Gerätetechnik GmbH, Überlingen, Germany

[21] Appl. No.: 08/743,111

[22] Filed: Sep. 19, 1996

[30] Foreign Application Priority Data

Sep. 27, 1995 [DE] Germany ..... 195 35 886

[51] Int. Cl.[7] ..... F41G 7/22; F42B 10/00

[52] U.S. Cl. ..... 244/3.16; 244/3.1; 244/3.15

[58] Field of Search ..... 244/3.1, 3.15, 244/3.16, 3.17, 3.18, 3.19

[56] References Cited

U.S. PATENT DOCUMENTS

| | | | |
|---|---|---|---|
| 3,897,918 | 8/1975 | Gulick, Jr. et al. | 244/3.19 |
| 4,039,246 | 8/1977 | Voigt . | |
| 4,315,610 | 2/1982 | Malueg | 244/3.16 |
| 4,396,878 | 8/1983 | Cole et al. | 244/3.15 X |
| 4,494,202 | 1/1985 | Yueh | 244/3.15 X |
| 4,508,293 | 4/1985 | Jones | 244/3.15 |
| 5,129,595 | 7/1992 | Thiede et al. | 244/3.16 |
| 5,440,314 | 8/1995 | Tabourier | 244/3.15 X |

FOREIGN PATENT DOCUMENTS

| | | |
|---|---|---|
| 0459066 | 12/1991 | European Pat. Off. . |
| 2339179 | 8/1977 | France . |
| 2618895 | 2/1989 | France . |

*Primary Examiner*—Bernarr E. Gregory
*Attorney, Agent, or Firm*—Evenson, McKeown, Edwards & Lenahan, P.L.L.C.

[57] ABSTRACT

A seeker head for target tracking missiles having an optical seeker de-coupled from the movements of the missile has a non-rotating platform (16), which is mounted in the missile for rotation about pitch and yaw axes about an origin (30), the platform carrying the optical seeker. A missile-fixed torquer assembly (74) for generating toques about mutually orthogonal axes (48,52) directly engages the platform (16). An inertial sensor unit (26) is mounted on the platform (16), the signals from the inertial sensor unit (26) being applied to the torquer assembly (74) to de-couple the platform (16) from the movements of the missile. A particular way of arranging the inertial sensorunit (26) and a particular design of the torquer assembly are described.

6 Claims, 3 Drawing Sheets

SEEKER HEAD FOR MISSILES

The invention relates to a seeker head for target tracking missiles having an optical seeker de-coupled from the movements of the missile.

Target tracking missiles have a seeker head, which conventionally is arranged behind a cover transparent for infrared radiation, a "dome". The seeker head has a seeker. This seeker consists of an imaging optical system, which usually images a field of view lying at infinity and containing the target to be tracked on a detector sensitive to infrared radiation. In prior art seeker heads, the seeker is gyro-stabilized, such that it is de-coupled from the movements of the missile. The seeker with the optical axis of the imaging optical system maintains its orientation in space, even if the missile makes pitch, yaw or roll movements.

In prior art seeker heads, the optical system, in the form of a Cassegrain type optical system with an annular concave mirror and a plane secondary mirror facing the concave mirror, is gyro-stabilized by rotating itself and thereby serving as gyro rotor. This gyro rotor is mounted on an inner gimbal suspension. The detector is missile-fixed and arranged substantially in the intersection of the gimbal axes of the inner gimbal suspension. The gyro rotor is radially magnetized and is precessed towards the target by a precession coil surrounding the gyro rotor depending on a.c.-signals from the detector, whereby the optical axis and the axis of rotation of the gyro rotor continuously follows the target. In such systems, the "look angle" of the seeker head, i.e. the angle between the optical axis of the imaging optical system and the longitudinal axis of the missile, is limited.

Gimbal suspended, gyro stabilized platforms are known. Such platforms carry an inertial sensor unit which responds to movements of the platform in inertial space. Such inertial sensor unit may, for example, include two two-axis rate gyros having crossed spin axes. The signals of the rate gyros are applied to servomotors or torquers. The servomotors or torquers counter-act each movement of the platform in inertial space. In such a system, the torquers engage the gimbals about the gimbal axes: One torquer acts between the structure and an outer gimbal of the gimbal suspension. A second torquer acts about a 90° angularly offset axis between the outer gimbal and an inner gimbal or the platform.

It is the object of the invention to provide a seeker head for missiles, which is of simple design and requires little space, and which permits large look angles and the use of image resolving detectors such as matrix detectors.

According to the invention this object is achieved by a non-rotating platform, which is mounted in the missile for rotation about pitch and yaw axes about an origin, the platform carrying the optical seeker, a missile-fixed torquer assembly for generating toques about mutually orthogonal axes by directly engaging the platform, and an inertial sensor unit mounted on the platform, the signals from the inertial sensor unit being applied to the torquer assembly to de-couple the platform from the movements of the missile.

The platform may be supported by means of a gimbal suspension, the platform extending around said gimbal suspension. The optical seeker preferably comprises a Cassegrain type optical system, having a concave mirror facing the field of view and a secondary mirror facing the concave mirror, and a detector, the field of view being imaged on the detector through the concave mirror and the secondary mirror, the inertial sensor unit being mounted on the secondary mirror on the side thereof remote from the concave mirror.

The torquer assembly comprises a missile-fixed stator having four pairs of pole pieces which are angularly spaced by 90° about the longitudinal axis of the missile. The pole pieces of each pair define an air gap therebetween, which is limited by spherical surfaces, the spherical surfaces being curved substantially about the origin. Permanent magnets are provided which, together with the pole pieces form a magnetic circuit, a radial magnetic field being generated in the air gap. An armature is attached to the platform, the armature having four elongated, arcuate coils with circumferentially extending turns, neighbouring coils being angularly offset by 90°. Each of these coils extends with an arcuate coil section into the airgap of a respective one of the pairs of pole pieces.

The detector is a matrix detector, which is mounted on the platform and is movable therewith. the detector is cooled by a cooler. The cooler communicates with a missile-fixed coolant reservoir through a flexible connection. The flexible connection passes through the origin.

An embodiment of the invention is described in greater detail hereinbelow with reference to the accompanying drawings.

DETAILED DESCRIPTION OF THE INVENTION

Figure 1:
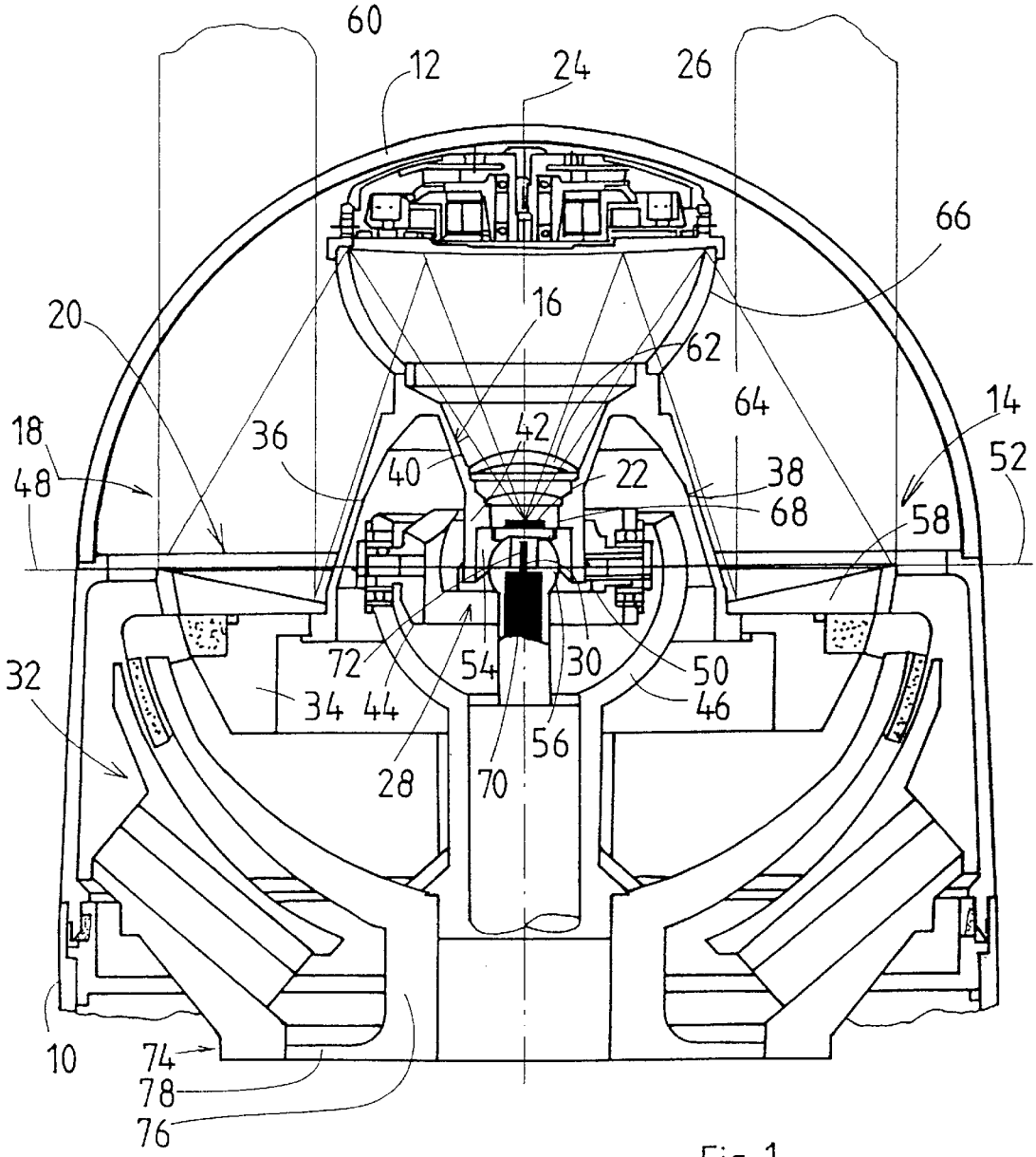
FIG. 1 is a longitudinal sectional view of a seeker head with a gyro stabilized platform carrying the seeker, the seeker of the platform being arranged to be aligned with a target by a missile-fixed torquer assembly directly engaging the platform.

Referring to FIG. 1, numeral 10 designates the cylindrical structure of a missile. The structure 12 is closed by a dome of a material transparent to infrared radiation. A seeker head, which is generally designated by numeral 14, is mounted in the missile behind the dome 12. The seeker head 14 has a platform 16. The platform carries a seeker 18. The seeker 18 consists of an imaging optical system 20 and a detector 22. Thus the imaging optical system 20 and the detector 22 are rotatable together with the platform. The detector 22 is arranged on the optical axis 24 of the imaging optical system 20 and is aligned therewith. the detector 22 is a matrix or mosaic detector with a two-dimensional array of detector elements. Furthermore, the platform 16 carries an inertial sensor unit 26. The inertial sensor unit 26 responds to attitude changes of the platform 16 relative to inertial space. The inertial sensor unit comprises two rate gyros the input axes of which are mutually orthogonal and orthogonal to the optical axis 24. The input axes define a coordinate system the z-axis of which extends in the direction of the optical axis 24 and the x- and y axes of which are parallel to the input axes of the rate gyros.

The platform 16 is suspended in the structure of the missile by means of an central gimbal suspension 28. Thereby the platform 16 is universally rotatable about an origin 30, i.e. is rotatable about a pitch axis and a yaw axis. The origin 30 is defined by the intersection of the gimbal axes of the central gimbal suspension. The origin 30 also represents the coordinate origin of the platform-fixed coordinate system.

A torquer assembly 32 engages directly the periphery of the platform 16. The torquer assembly is missile-fixed. The torquer assembly is adapted to exert torques both about the platform-fixed x-axis and about the platform-fixed y-axis and to rotate the platform about these axes. The torquer assembly is so designed that the torques can be exerted also in the case when the platform 16 has already been rotated about one or the other axis.

In detail, the construction of the seeker head 14 is as follows.

The platform 16 has a ring body 34. The inner edge of the ring body 34 communicates with a conical section 36, tapering towards the field of view side, of a central part 38. The inner edge o the section 36 communicates with an inner conical section 40 tapering towards the origin 30. A substantially cylindrical section 42 is mounted at the inner edge of the section 40.

The central gimbal suspension 28 comprises an outer gimbal 44 which is rotatably mounted in a semispherical support 46 about an x-axis 48 extending in the plane of the paper of the left part of FIG. 1 and orthogonal to the optical axis 24. An inner gimbal 50 is rotatably mounted about a y-axis 52, which is orthogonal to the x-axis 48 and to the optical axis 24. Sectional views taken along two mutually perpendicular longitudinal planes are shown in the left and the right half of FIG. 1. The left half of FIG. 1 shows a section along a longitudinal plane containing the x-axis. The right half shows the section along a plane perpendicular thereto. In this plane, the y-axis 52 and the mounting of the inner gimbal 50 in the outer gimbal 44 can be seen. The inner gimbal 50 accommodates the cylindrical section 42 of the central part 38 of the platform 16. Therefore, the platform is mounted for rotation about the x-axis and the y-axis but non-rotatable about a longitudinal axis. The central gimbal assembly 28 is accommodated within the annular space defined by the sections 36, 40 and 42. The origin 30 lies closely above the upper surface of the ring body 34, as viewed in FIG. 1.

The seeker 18 mounted on the platform 16 and rotatable therewith comprises the imaging optical system 20 and the detector 22. The optical system 20 is a Cassegrain type system and comprises an annular concave mirror 58. The concave mirror 58 is mounted on the ring body 34 of the platform 16. Furthermore, the optical system comprises a slightly convex secondary mirror 60 facing the concave mirror and two lenses 62 and 64, which are mounted in the inner conical section 40 of the central part 38 of the platform. The imaging path of rays extends from the field of view lying at infinity parallel to the optical axis 24 to the concave mirror 58. The concave mirror 58 focuses the beam via the secondary mirror 60 and through the lenses 62 and 64 on the detector 22. The secondary mirror 60 is supported on the central part 38 of the platform 16 through struts or a heavily convex lens element 66.

The platform 16 is stabilized by the inertial sensor unit 26. The inertial sensor unit 26 is mounted on the back of the secondary mirror 60. There the inertial sensor unit 26 can be accommodated, in a spacesaving way, in a dead space which is present anyhow. The inertial sensor unit has a spherical outer surface shaped to not interfere with the rotary movement of the seeker.

The detector 22 is cooled. A Joule-Thomson cooler 70 is connected to a coolant reservoir. The Joule-Thomson cooler 70 has an expansion nozzle 72. The platform is mounted with a spherical bearing bushing 54 on a missile-fixed ball 56. The bearing bushing 54 and the ball 56 form a seal for the coolant gas of the Joule-Thomson cooler expanding against a carrier 68 of the detector 22, such seal permitting the universal rotary movement of the platform.

The detector 22 is an image resolving detector in the form of a mosaic detector.

Figure 2:
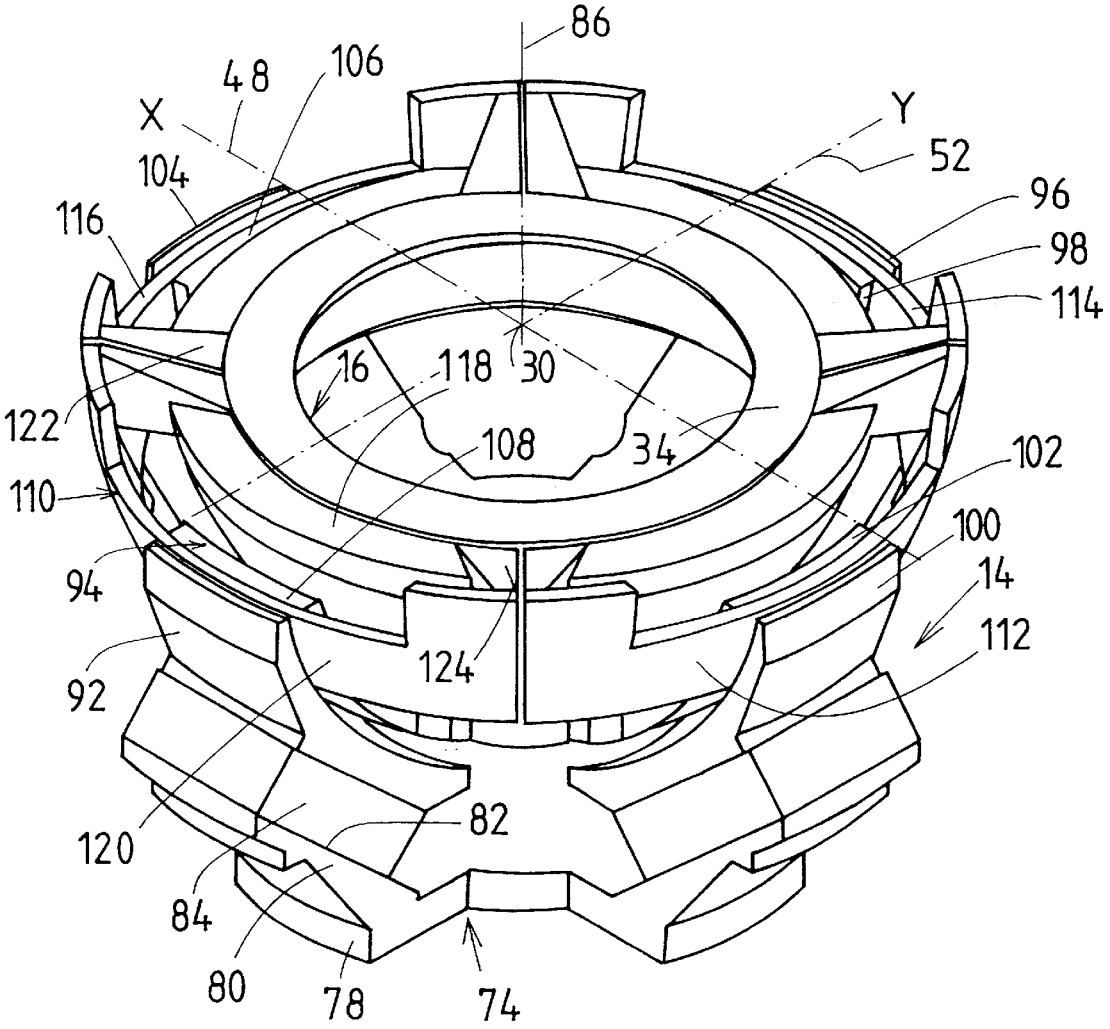
FIG. 2 is a perspective view of the torquer assembly in its central position illustrated in FIG. 1.
Figure 3:
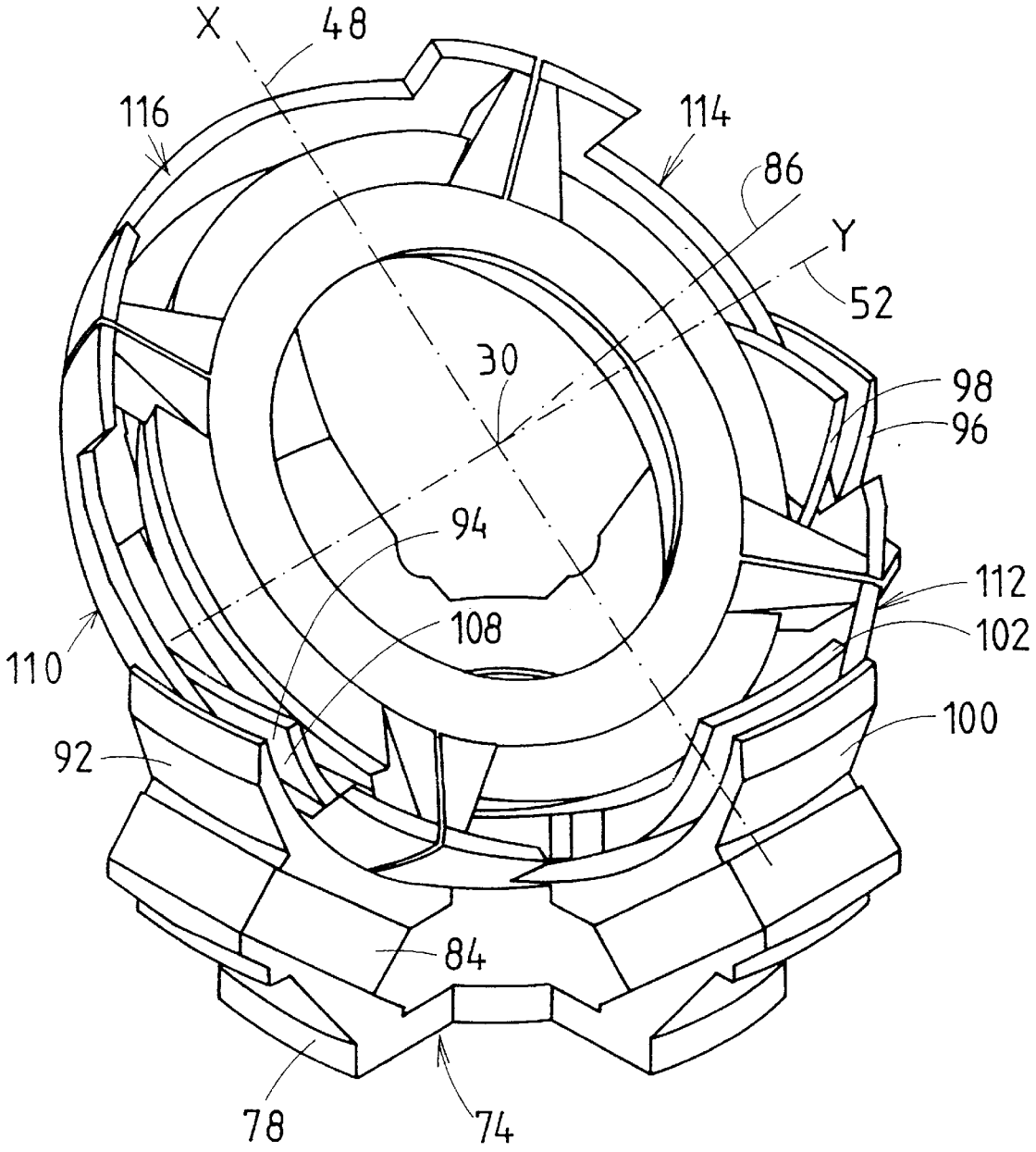
FIG. 3 is a perspective view of the torquer assembly with the platform rotated about one axis.

The torquer assembly 34 is missile-fixed and directly engages the ring body 34 of the platform 16. The construction of the torquer assembly can best be seen from the perspective illustration of FIGS. 2 and 3. In FIGS. 2 and 3, only the ring body 34 is shown of the platform 16.

Referring to FIGS. 2 and 3, numeral 34 designates the ring body of the platform 16. The platform 16 is universally rotatably mounted about the origin 30 by means of the central gimbal suspension 28, as illustrated in FIG. 1. A stator 74 of the torquer assembly 32 is positioned relative to the origin 30. The stator 74 has a central tubular body 76 (FIG. 1) of magnetizable material. Four radial flange portions 78 are provided on the central tubular body 76 at the end thereof remot from the platform, the flange portions being angularly spaced by 90°. Magnet carriers 80 with plane contact surfaces 82 are integral with the flange portions and extend substantially tangentially to the origin 30. Plate-shaped permanent magnets 84 are placed wit their undersides on the magnet carriers 80. The permanent magnets 84 are magnetized perpendicularly to the contact surface 82. Thus the permanent magnets 84 generate a magnetic field which is substantially radial to the origin 30.

Four pairs of pole pieces are provided on the stator 74. The pole pieces are arranged around the axis of the tubular portion 76 passing through the origin 30 and are angularly offset by 90°. Angularly, the pole pieces are in alignment with the flange portions 78 and magnet carriers 80. The pole pieces of each pair form an air gap therebetween. The air gap is limited by spherical surfaces. The spherical surfaces are curved about the origin 30. The outer pole pieces of each pair are attached to the upper side of a respective one of the permanent magnets 84. The inner pole pieces are integral with the central tubular part 76 at the end thereof remote from the platform.

The platform-fixed coordinate system with the z-axis 86 normal to the plane of the platform and vertical in FIG. 2 and the mutually orthogonal x- and y-axes 48 and 52, respectively, perpendicular to the z-axis 86 is also illustrated in FIGS. 2 and 3. The coordinate origin lies in the origin 30. Vertical planes pass through the x-axis 28 and through the y-axis 48 in FIG. 3. The flange portions, magnet carriers, permanent magnets and pole pieces are symmetrical to these vertical planes. A pair of pole pieces 92 and 94 and a pair of pole pieces 100 and 102 offset thereto by 90° can be seen in the foregound of FIG. 3. In the background, the ends of the respective diametrically opposite pole pieces 96 and 98, and 104 and 106 can be recognized. The pole pieces 92, 96, 100 and 104 are "outer" pole pieces, i.e. lie farther away from the origin 30 than the "inner" pole pieces 94, 98, 102 and 106. Air gaps 108 are defined between the outer and inner pole pieces. Each air gap 108 is limited by spherical surfaces centered to the origin 30. A magnetic circuit extends from the inner pole face of the permanent magnet 84 through the outer pole piece 92, the air gap 108, the inner pole piece 94, the central tubular part 76, the flange portion 78 and the magnet carrier 80 to the other, outer pole face of the permanent magnet 84. Thereby, a substantially radial magnetic field is generated in the air gaps. The magnetic lines of force are uniformly distributed over the area of the air gap. The remaining pairs of pole pieces are of identical design.

Four coils 110, 112, 114 and 116 are attached to the platform with a respective angular offset of 90°. The coils 110 and 114 are diametrically opposite, and the coils 112 and 116 are diametrically opposite. The coils 110, 112, 114 and 116 are arcuate. Coil 110 is described here. The remaining coils are identical therewith.

The coil 110 has an arcuate inner section 118 and an also arcuate outer section 120. Inner section 118 and outer section 120 are interconnected by short end sections 122 and 124. In the inner section 118 and in the outer section 120, the wires extend circumferentially with respect to the platform 16. In the end sections, the wires extend radially. Thus turns are formed which are substantially parallel to the plane of the platform 16. The outer section 120 is limited by spherical surfaces curved about the origin 30. As can best be seen from FIGS. 1 and 2, the wires of the turns in the inner section 118 of each coil are wound in a plurality of layers such that a compact bundle is obtained. In the end sections 122 ans 124, the wires are fanned out. The outer sections 120 are flat with one layer or few layers of turns with comparatively large axial width, whereby the outer sections 120 may extend into a rather narrow air gap 108.

The respective end sections of neighbouring coils 110, 112, 114 and 116 are adjacent to each other. Each of the coils 110, 112, 114 and 116 extends around one of the inner pole pieces 94, 102, 98 or 106, respectively. The respective outer sections 120 are guided in the air gaps 108 between the outer pole pieces and the inner pole pieces, for example between the pole pieces 92 and 94 in FIG. 2.

Diametrically opposite coils and magnetic circuits represent a torquer acting about a respective axis. The coils 110 and 114 together with the magnetic circuit passing through the pole pieces 90 and 94 and the pole pieces 96 and 98, respectively, provide a torquer acting about the x-axis 48. Forces are exerted on the coils. The direction of the forces is normal to the direction of the magnetic field and normal to the current flowing circumferentially through the coils, i.e. tangential in the longitudinal planes passing through the axis of the tubular part 76. Correspondingly, the coils 112 and 116 together with the magnetic circuits passing through the pole pieces 100 and 102, and the pole pieces 104 and 106, respectively, represent a torquer acting about the y-axis. The torquers are energized by currents which are applied to the coils. With this system, the torquers engage directly the platform 16 an not axles of a gimbal suspension of the platform.

The signals from the inertial sensor unit 26 are appied to the torquer assembly 74 such that the torques exerted on the platform by the torquer assembly 74 counter-act movement of the platform 16 in inertial space. Thereby, the platform 16 is de-coupled from the movements of the missile. Furthermore, depending on the image processing of the image of the field of view received by the detector 22 torquesare exerted on the platform through the torquer assembly 74, which torques cause the optical axis 24 to follow a detected target. Large look angles are possible with this system. The torquer assembly 74 is operative also with such large look angles.

The central gimbal suspension 28 has the only function of universally supporting the platform about the origin 30. As the central gimbal suspension 28 does not contain torquers, it can be made very space saving. The mounting does not contain any roll axis, which would require transfer of signals through slip rings. The gimbal axes are kinematically equivalent.

Thus a very compact seeker head with small movable masses is obtained. The torquer assembly 74 has high bandwidth. Therefore the seeker head is able to follow also quick movements. In addition, the seeker head is also adapted to be used in rolling missiles.

As the detector is rotated together with the optical axis 24, the detector 22 may be made relatively small. Thereby, it can be cooled down very quickly.

What is claimed is:

1. A seeker head for target tracking missiles having an optical seeker de-coupled from the movements of the missile, comprising:

(a) a non-rotating platform, which is mounted in the missile for rotation about pitch and yaw axes about an origin, the platform carrying the optical seeker, (b) a missile-fixed torquer assembly for generating torques about mutually orthogonal axes by directly engaging the platform, and (c) an inertial sensor unit mounted on the platform, the signals from the inertial sensor unit being applied to the torquer assembly to de-couple the platform from the movements of the missile, wherein (d) the optical seeker comprises a Cassegrain type optical system, having a concave mirror facing the field of view and a secondary mirror facing the concave mirror, and a detector, the field of view being imaged on the detector through the concave mirror and the secondary mirror, and (e) the inertial sensor unit is mounted on the secondary mirror on the side thereof remote from the concave mirror.

2. A seeker head as claimed in claim 1, characterized in that the platform is supported by means of a gimbal suspension, the platform extending around said gimbal suspension.

3. A seeker head as claimed in claim 1, characterized in that (a) the torquer assembly (74) comprises a missile-fixed stator having four pairs of pole pieces (92,94;100,102;96,98;104,106) which are angularly spaced by 90° about the longitudinal axis of the missile, (b) the pole pieces (92,94;100,102;96,98;104,106) of each pair define an air gap (108) therebetween, which is limited by spherical surfaces, the spherical surfaces being curved substantially about the origin, (c) permanent magnets (84) are provided which, together with the pole pieces (92,94;100,102;96,98;104,106) form a magnetic circuit, a radial magnetic field being generated in the air gap (108), (d) an armature is attached to the platform, the armature having four elongated, arcuate coils (110,112,114,116) with circumferentially extending turns, neighbouring coils being angularly offset by 90°, and (e) each of these coils (110,112,114,116) extends with an arcuate coil section (120) into the airgap of a respective one of the pairs of pole pieces (92,94;100,102;96,98;104,106).

4. A seeker head as claimed in claim 1, characterized in that the detector (22) is mounted on the platform (16) and is movable therewith.

5. A seeker head as claimed in claim 4, characterized in that the detector (22) is a matrix detector.

6. A seeker head as claimed in claim 4, characterized in that (a) the detector (22) is cooled by a cooler (68), (b) the cooler communicates with a missile-fixed coolant reservoir (70) through a flexible connection (72), and (c) the flexible connection (72) passes through the origin.

* * * * *